United States Patent [19]

Ameling

[11] Patent Number: 4,649,653

[45] Date of Patent: Mar. 17, 1987

[54] PROCESS AND APPARATUS FOR THE DRYING OF TEXTILE MATERIAL

[75] Inventor: Bernhard Ameling, Coesfeld, Fed. Rep. of Germany

[73] Assignee: Thies GmbH & Co., Coesfeld, Fed. Rep. of Germany

[21] Appl. No.: 811,275

[22] Filed: Dec. 20, 1985

[30] Foreign Application Priority Data

Dec. 20, 1984 [DE] Fed. Rep. of Germany ..... 3446618

[51] Int. Cl.[4] ..... F26B 3/10; F26B 17/10

[52] U.S. Cl. ..... 34/10; 34/57 R; 34/57 E; 34/79; 55/461; 55/471

[58] Field of Search ..... 34/57 E, 57 A, 73, 77, 34/79; 55/406, 461, 467, 471

[56] References Cited

U.S. PATENT DOCUMENTS

| | | | |
|---|---|---|---|
| 3,993,463 | 11/1976 | Barr | 55/461 |
| 4,081,382 | 3/1978 | Buzga | 34/57 E |
| 4,085,518 | 4/1978 | Jackson et al. | 34/104 |
| 4,278,550 | 7/1981 | Watts | 55/17 |
| 4,441,262 | 4/1984 | Gazzoni | 34/57 E |
| 4,447,965 | 5/1984 | Bray | 34/83 |

*Primary Examiner*—Larry J. Schwartz

*Attorney, Agent, or Firm*—Charles W. Fallow; Martin P. Hoffman; Mitchell B. Wasson

[57] ABSTRACT

Disclosed herein are a method and apparatus for the drying of textile material by way of a penetration with preheated air, wherein air is circulated and is preheated at the same time and is dehumidified as a result of its separation. In order to overcome the disadvantages of an independent separator, the air is accelerated and at the same time is directed toward a series of obstacles disposed at close distances from one another and set up at an oblique angle to the air's direction of movement. The part of the air passing through the spaces between the obstacles is guided past a collecting basin for liquid, from where the separated liquid is carried off. A special, perforated wall is disposed for this purpose at a small distance from the actual blower wall, whereby the space between the perforated wall and the actual blower wall leads into a collecting basin having a liquid outlet equipped with a valve.

6 Claims, 6 Drawing Figures

PROCESS AND APPARATUS FOR THE DRYING OF TEXTILE MATERIAL

The invention relates on the one hand to a process for drying textile material, especially in the form of wound packages, and to an apparatus for carrying out the process.

BACKGROUND

In the prior art, for example, in German AS No. 2109696 and in German Pat. No. 970012, processes and apparatuses have been disclosed for drying textile wound packages by means of circulating air in closed systems while superheating. Such closed systems comprise a textile goods container as well as an air circulation system including a line and a pump. Upstream of the textile material container, a preheater has been inserted in the system by means of which the air is heated or even superheated. Downstream of the textile goods container, a condenser and a separator are inserted into the circulation system. By means of the condenser, the air having been guided through the textile material and thus humidified, is cooled, while in the succeeding separator, the condensed liquid is carried away. After the separation of the liquid, the air is again fed to the preheater by way of the pump and is circulated further through the closed system, until the desired degree of drying of the textile material has been achieved.

The separator provided in such systems makes the constructional expense of the apparatus relatively expensive. Furthermore, we find that because of the separator, relatively high pressure losses occur in the closed system, for which reason the pump must have a relatively high energy consumption. Otherwise, the effectiveness of the separator in drying the circulation air is less than desirable; therefore, since the air fed to the textile material is still relatively moist, the drying process in its totality is relatively time consuming.

Therefore, the invention has an object of developing the process and the apparatus of the type described above in such a way that a desired degree of drying may be achieved within a shorter period of time and with less consumption of energy. A further object is to reduce the expense of the apparatus required for this purpose.

SUMMARY OF THE INVENTION

The starting point of the deliberations according to the invention are the disadvantages cited above, the cause of which may be traced back to the separator. Therefore, the first step for the solution according to the invention is to be seen in the fact not to perhaps increase the effectiveness of the separator used hitherto in order thus to arrive at better results but, since the expenditure for the apparatus is to be reduced, to take some paths which make possible the abandonment of the hitherto used separator. Starting from this postulate, it has been contemplated to adduce the hitherto used pump for the separation of the absorbed moisture (which pump probably would better be called a blower) by means of which the revolving air is put and held in circulation. When air passes through the blower, the air experiences a not inconsiderable acceleration. The airstream mixed with the moisture absorbed from the textile material consists of individual particles of variable weight, namely on the one hand gaseous air and on the other hand solid and possibly at least partly vaporized water particles, the individual particles of which react variably strongly to an acceleration. This is a discovery of which use is made in implementing a solution according to the invention. For, the acceleration of the air and the simultaneous alignment of the accelerated air in a direction toward a series of obstacles disposed at close distances from one another, utilizes the variable reactions of the various particles of the stream of air under the effect of an accelerating force. Especially in the case of an essentially circular acceleration, as can be achieved for example by means of a radial blower, heavier particles of the stream of air are moved more quickly to the peripheral side of a corresponding acceleration channel or space. This means that under the action of the accelerating force, the relatively heavier particles tend to achieve a quicker approach to the circumferential wall of the acceleration channel. Now whenever we are dealing with a series of obstacles disposed at close distance in relation to one another, the heavy particles tend to pass through the small spaces between the obstacles considerably more strongly than do the lighter, genuinely, gaseous particles of the accelerated airstream. It is thus possible to achieve by means of the acceleration of the air flow, which is necessary anyway, a simultaneous separation of the moisture from this stream of air. Whenever one guides the heavy particles through the narrow obstacle spaces, naturally still with a small part of genuine gaseous particles, past a basin disposed in the path of further movement, the separated moisture particles accumulate there and then may easily be removed from circulation.

Reference has been made previously to the use of a radial blower, merely for the easier understanding of the invention. Naturally, instead of a radial blower, an axial blower may also be used, in the case of which the main acceleration of the air current takes place in an axial direction; however, the acceleration also has a component in the peripheral direction which may be used for the purpose of using the variable reaction of the variably sized particles to separate the relatively heavy water particles from the stream of air. Especially when using a radial blower according to the invention for accelerating the air current, the objects of the invention may be achieved in a very simple manner through the fact that essentially in parallel to the peripheral wall of the acceleration channel of this blower, a second wall is provided which, with perforations provided in it, provides a series of obstacles provided at distances from one another. The obstacles then consist of the connecting bridges between the perforations of the wall; the space lying behind the perforated wall, and limited by the actual housing wall, is the space for the reception of the separated heavier water particles. These, and a small part of gaseous air particles are conducted through this space and finally are moved past a collection basin where the heavier water particles (which run possibly along the actual housing wall or which are still barely carried in the stream of air), flow together or drop from said current in consequence of the delay of the air current, since its carrying capacity is reduced correspondingly because of the delay of the air current.

The perforated wall, not only in the case of a radial blower but quite generally, may be developed as a perforated wall in the manner of the drum wall of a washing machine. It may also be a wall first closed within itself into which U-shaped incisions are punched. The part of the wall enclosed by the incisions may then be bent out from the plane of the wall along the imaginary joining of the two legs of the U in such a way that the opening formed opposes the accelerated stream of air and makes possible an easier, more effective entry of the heavier particles.

BRIEF DESCRIPTION OF THE DRAWINGS

Subsequently, the invention will be explained going further into detail by way of example with reference to the drawings, wherein.

DESCRIPTION OF THE PREFERRED EMBODIMENT

Figure 1:
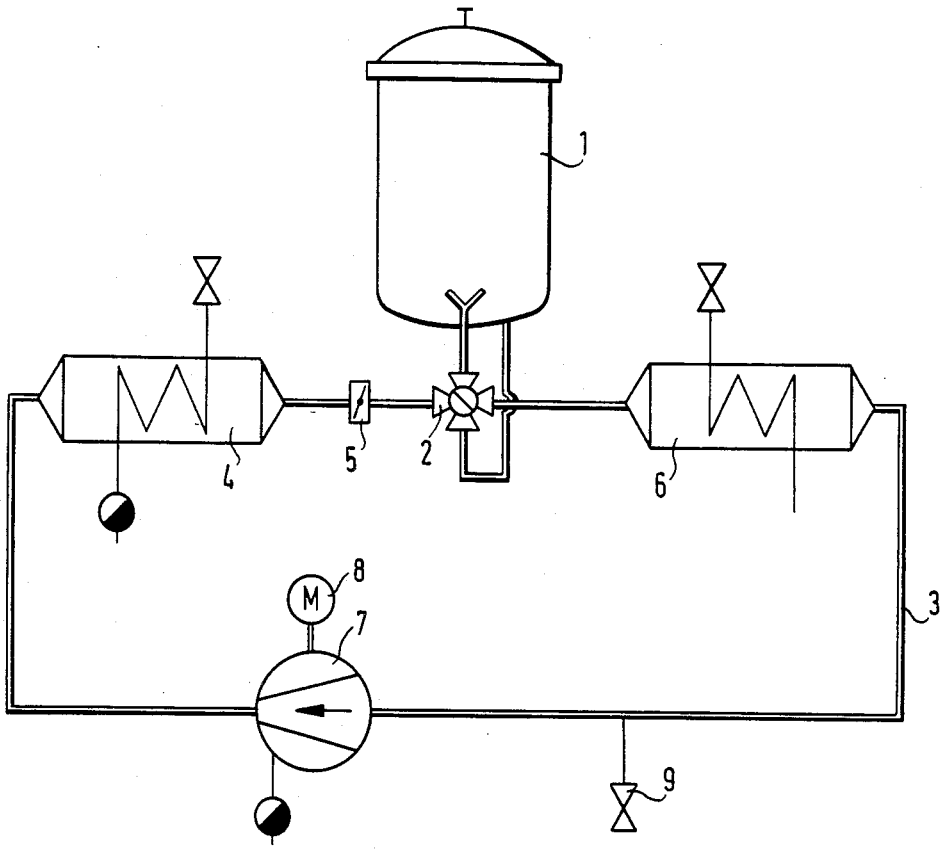
FIG. 1 is a schematic overall view of an apparatus according to the invention.

First of all, the apparatus according to the invention shown schematically in FIG. 1 is explained in its basic structure.

A container 1 for textile goods is inserted into a revolving or circulating line 3 by way of a multiway valve 2. Before the textile goods container 1, a preheater 4 is inserted into the line 3, and between the preheater 4 and the container 1 for textile goods, a throttle 5 has been provided. Behind the container 1 for textile goods lies a condenser 6 in the line 3. Finally, in addition, a pump 7 is provided in the line 3 which pump is driven by way of a motor 8.

By way of a valve 9, after filling the textile material container with a textile good and after hermetic closure of the container 1, the entire system is fillable with compressed air. The compressed air, put into circulation by way of the pump 7, flows at the same time through the preheater 4, then in its preheated state through the textile goods container 1, and from there through the condenser 6 where the compressed air treated with moisture in the textile goods container 1 is cooled, in order to pass again through the pump 7 after separation of the moisture. For the sake of simplicity, in FIG. 1, the illustration of means for carrying off the moisture or liquid from the apparatus has been entirely omitted.

Figure 2:
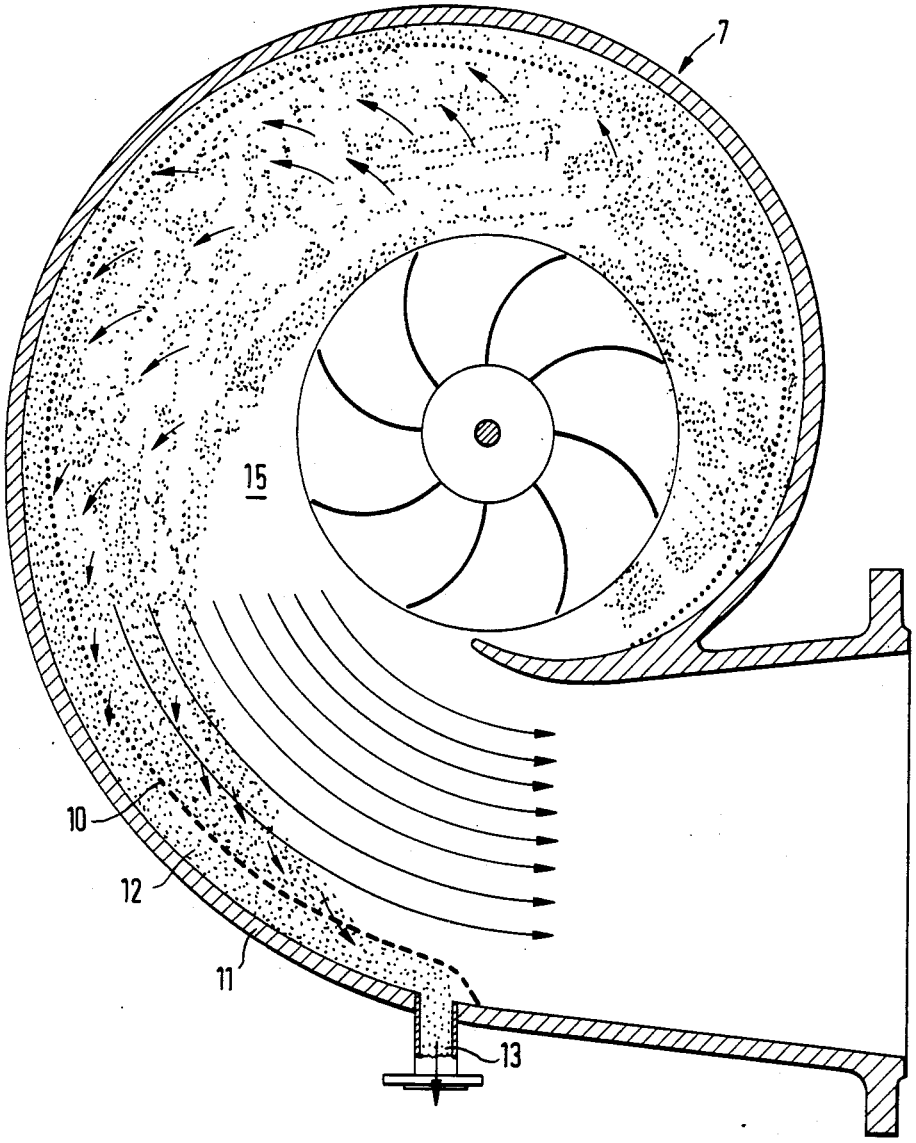
FIG. 2 is a cross-section through a radial blower to be used with the apparatus according to the invention.

FIG. 2 shows in a cross-sectional presentation a pump developed especially in the form of a radial blower to be used preferably in practicing this invention. In view of the general knowledge of radial blowers, there is no need for a more detailed explanation with the exception of the special construction according to the invention. This special construction is in the fact that on the inside of the pump housing, a wall 10 is provided approximately in parallel to the outside wall, whereby a space 12 is defined between the actual housing wall 11 and the additional wall 10, leading into a carrying off sleeve 13 which at the same time represents a collection basin for separated liquid. A valve, now shown, and serving for the purpose of closure follows the carrying off sleeve 13.

The above mentioned additional wall 10 is a wall with perforations and in the present invention, it represents a series of obstacles disposed at close distances from one another, with gaps formed therebetween by perforations. The actual obstacles are the connecting bridges between the perforations.

Figure 3A:
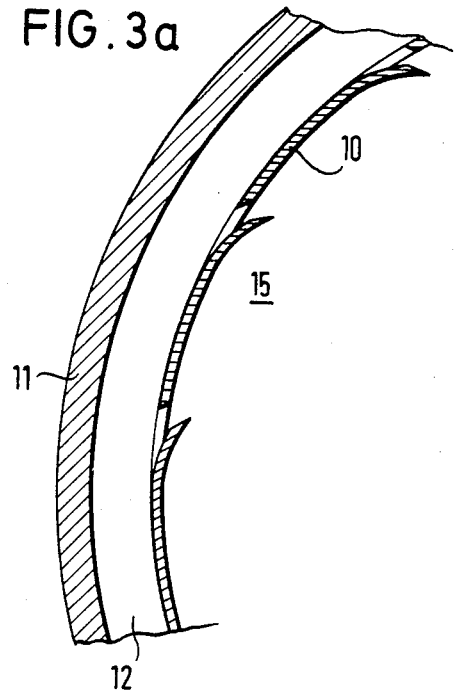
FIGS. 3*a* and 3*b* show a piece of radial blower outside wall and of the perforated wall placed in front thereof, in cross-section and corresponding to FIG. 2 at an enlarged scale.
Figure 3B:
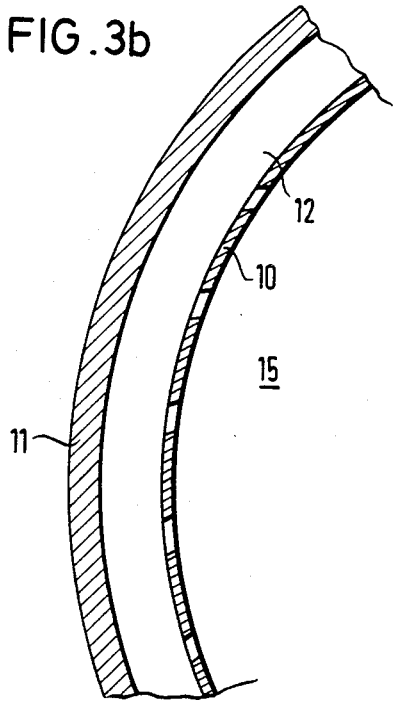
Figure 4A:
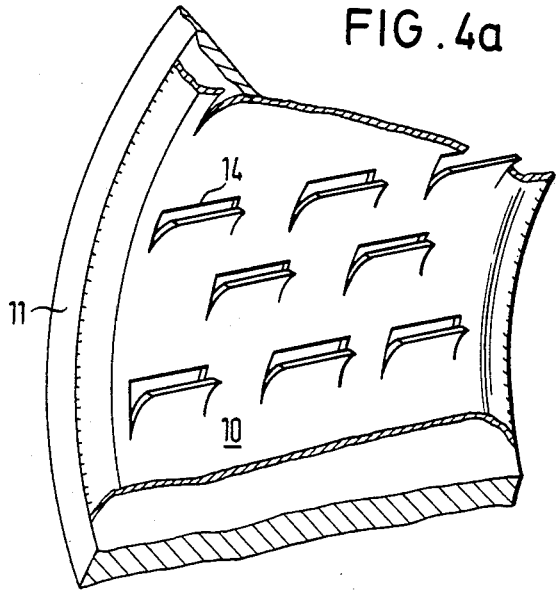
FIGS. 4*a* and 4*b* show the same piece of wall as in FIGS. 3*a* and 3*b* in perspective view, viewed essentially from the inside of the acceleration channel of the radial blower.

Referring now to the FIGS. 3*a*, 3*b* and 4*a*, 4*b*, in the case of the embodiment according to FIGS. 3*a* and 4*a*, the perforated wall 10, placed in front of the actual housing wall 11, is developed as a simple metal sheet into which U-shaped incisions 14 have been provided. The sheet metal area enclosed on three sides by these incisions 14 is bent in the direction of the inside 15 of the actual blower channel. Whenever the U-shaped incisions are disposed in such a way that the base of the incision 14 connecting the two legs lies upstream, then the small wall elements, extended by bending toward the inside 15 of the blower channel, are projecting impediments with the effect of deflecting the heavier particles through the openings which have become free through the bending out.

Figure 4B:
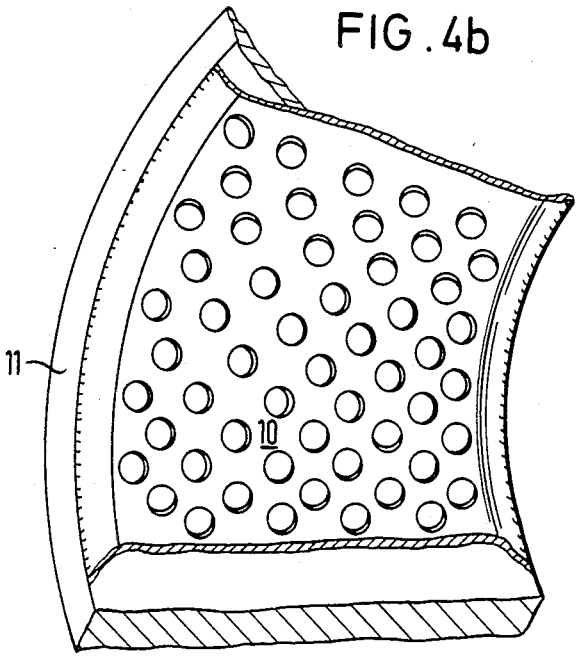

In the case of the embodiment according to FIGS. 3*b* and 4*b*, the perforated wall is developed in the manner of a washing machine drum wall, whereby it may be effective not to punch the punched out perforations strictly radially, but slightly inclined, so that a slanting perforation will result which may be aligned, similar to the perforations in the case of the embodiment of the FIGS. 3*a* and 4*a*, in the flow direction of the accelerated air current. As a result of this invention, any special separator has become superfluous so that the resulting apparatus is considerably simplified in its totality. This simplification is of substantial significance, especially when the forward channel of the radial blower shown in section in FIG. 2 is of a rectangular cross-section. For in that case, the perforated wall 10 may be built even subsequently into the radial blower.

By overcoming the necessity for a separator, the overall energy consumption for carrying out the drying process is reduced, since the flow losses caused by the use of a separator do not have to be compensated for by an increased blower energy.

I claim:

1. An apparatus for drying textile material, especially in the form of wound packages, by way of the textile goods being penetrated with preheated air, comprising:

a closable textile goods container having an inlet for the air and an outlet for the air, a circulation line connecting the inlet with the outlet outside of the textile goods container, an air blower inserted into the circulation line, and a preheater for the air in the circulation line between the blower and the textile goods container, the improvement wherein the air blower includes a wall having perforations oblique to the direction of movement of the accelerated air, which wall is disposed at a relatively small distance from the blower housing, the space between the perforated wall and said housing leading into a collecting basin for the liquid.

2. An apparatus as in claim 1, characterized in that said perforations are holes.

3. An apparatus as in claim 1, characterized in that said perforations are U-shaped incisions, each area enclosed on three sides by a U-shaped incision being bent out of the plane of the wall and thus forming an opening facing the accelerated air.

4. In a process for drying textile material, especially in the form of wound packages, comprising steps of circulating a stream of air through the textile goods by means of a pump, preheating said air at least once per circulation, removing from said air moisture absorbed from the textile material, the improvement wherein the air is accelerated at least once per circulation within said pump and at the same time is directed against a series of closely spaced impediments within said pump placed obliquely to the direction of movement of the accelerated air, and wherein that part of the air passing through the spaces between said impediments is guided past a collecting basin for receiving liquid drawn out of circulation.

5. A process as in claim 4, wherein the air is cooled prior to its circulation.

6. A process as in claim 4, wherein during said acceleration, the air is circulated in such a way that its direction of movmeent has a radial component.

* * * * *